United States Patent [19]

Fabregas et al.

[11] 4,006,041

[45] Feb. 1, 1977

[54] ONE STEP FILM-FORMING PHOSPHATIZATION OF METALLIC SURFACES AND COMPOSITION FOR EFFECTING SAME

[76] Inventors: Juan Brugarolas Fabregas, 92, Via Layetana, Barcelona, Spain; Frederic Gruber, 6 rue Auguste Thomas, Asniers, France

[22] Filed: Sept. 24, 1975

[21] Appl. No.: 616,430

Related U.S. Application Data

[63] Continuation-in-part of Ser. No. 516,739, Oct. 21, 1974, abandoned.

[30] Foreign Application Priority Data

Oct. 22, 1973 Spain ..... 420039
May 10, 1974 Spain ..... 426388

[52] U.S. Cl. ..... 148/6.16; 106/14; 260/29.6 MM; 260/29.6 MP; 427/380; 427/384; 427/388 A; 427/388 B; 427/388 C

[51] Int. Cl.[2] ..... B05D 7/14; B05D 3/02; C23F 7/26; C23F 7/08

[58] Field of Search ..... 427/372, 388, 380; 428/461, 469, 472; 148/6.16; 106/14; 260/29.6 MM, 29.6 MP

[56] References Cited

UNITED STATES PATENTS

| | | | |
|---|---|---|---|
| 3,053,691 | 9/1962 | Hartman et al. | 427/388 |
| 3,053,692 | 9/1962 | Pocock | 427/388 |
| 3,346,522 | 10/1967 | Schuster et al. | 148/6.16 X |
| 3,658,603 | 4/1972 | Boyer | 427/372 X |
| 3,706,604 | 12/1972 | Plaxton | 148/6.16 |

*Primary Examiner*—James R. Hoffman
*Attorney, Agent, or Firm*—Mark T. Basseches; Paula T. Basseches

[57] ABSTRACT

The present invention relates to a process for protecting metal surfaces from corrosion, and more particularly to a method for forming a phosphatized film on metal surfaces and a composition for accomplishing said result.

10 Claims, No Drawings

ONE STEP FILM-FORMING PHOSPHATIZATION OF METALLIC SURFACES AND COMPOSITION FOR EFFECTING SAME

This application is a continuation-in-part of our application Ser. No. 516,739, filed Oct. 21, 1974, and now abandoned entitled A PROCESS OF FILM-FORMING PHOSPHATIZATION OF METALLIC SURFACES.

BACKGROUND OF THE INVENTION

1. Field of the Invention

The present invention is in the field of forming protective coatings on metals, and more particularly the formation of such coatings through phosphatization.

2. The Prior Art

Phosphatization of steel has become increasingly important among processes for protection from corrosion, especially when followed by chromium plating or to assure good anti-corrosion protection and adherence of paints applied afterwards.

Many processes have been disclosed which result in the formation of metallic phosphates, usually zinc, iron and manganese having various crystalline or amorphic structures. Certain modifications to the processes seek to vary the speed of formation of phosphatic layers (including when cold) by means of accelerators and other auxiliary products such as humectants, dispersions and passivators among others. However, all these processes require a three part treatment, that is: first a phosphating bath; second a washing to eliminate non-combined acid products; and third a chromic acid based bath to passivate the phosphate layers and increase corrosion resistance.

It is therefore obvious that phosphating treatments heretofore known require costly, complex installations and that the treatment time is prolonged.

Where zinc or aluminum surfaces are to be treated, other systems are used based typically on phosphates and chrome coatings and accelerators for their attack, which procedures must be followed by washing to eliminate any uncombined products.

In all cases, prior procedures, by requiring that the surface of the metal be attacked to form protective substances insoluble in water, required as a corrolary that the procedure be carried out at a relatively high temperature and for a relatively protracted period of time since the compounds formed are usually soluble in water, becoming insoluble only upon consumption of acid on the surface and the consequent progressive formation of metallic ions which are being added to the interfacial film.

Broadly stated, this application relates to a method for forming in a single application a corrosion resistant, reticulated coating on metals, such as iron, zinc, aluminum, cadmium, steel, cooper and alloys thereof, and which provides, in addition, an adherent surface for paint. The method includes the steps of subjecting the metal to be treated to a treatment solution obtained by dissolving in phosphoric acid or a derivative thereof, metal salts selected from the group of zinc, manganese, iron and lead to provide a solution including primary phosphates of said metals, adding thereto an organic reducing agent, partially oxidizing the resultant composition through the addition of chromic acid or its salts, to produce in solution trivalent chromium ions, and applying said solution, preferably but not necessarily in heated condition, to the said metal to be treated.

The treated metal surface is thereafter dried to provide thereon a reticulated film strongly adherent to the base metal.

Preferably a polymeric compound in solution. emulsion or dispersion is added to the treatment composition, whereby polymeric elements are incorporated in the film, improving the anti-corrosive properties and rendering the same especially receptive to subsequent paint coatings.

The drying step is preferably carried out in a heated environment, augmenting the quality of the coating or film.

The treatment solution is acid, preferably in the range from about pH 1 to 3.

From the foregoing it will be appreciated that the instant method offers the innovation, as compared to phosphatizing procedures heretofore known, or eliminating the rinsing and chromic passivation steps. Thus, the procedure is greatly simplified in that the treatment consists of only one impregnation, dipping or coating, combining phosphating, washing and passivation in a single step. By thus eliminating treatment stages, savings in installation costs, time, and increased production output are assured.

Additionally, the operation may be carried out when cold, thereby offering the possibility of energy conservation.

Whereas conventional phosphating methods offer limited protection against corrosion, due to rapid reoxidation, the protection against corrosion given by the instant process is far superior, due both to the film forming and water repellent characteristics of the coating.

Further applications of rust preventitive oils and paints need not be immediately effected due to the durable nature of the coating. The surface provides improved adherence to subsequently applied paints.

An element of novelty of the procedure which both simplifies application and increases protection lies in the characteristic of the admixed components to form a reticulated film, which film engulfs all of its components and any residual acidity, with the resultant passivation closing the pores in the film.

Without limitation to any specific theory, the improved operation of the procedure, and its ability to eliminate rinsing and chromic passivating stages, is considered to be a consequence of the formation in situ of trivalent chromium salts which have a complex, closed structure, since during the reaction trivalent chromium is being generated. The film obtained is not hygroscopic, in contrast to the films generated when traditional zinc or iron phosphates are employed in the usual manner. The film is insoluble in water, especially when dried at high temperatures and offers notable anti-corrosive protection.

In contrast to traditional procedures, the phosphates generated in accordance with the process do not have to become insoluble by progressive attack of the metal, the film being deposited and becoming insoluble during drying. The thickness of the phosphate coat will depend on the intensity of the attack on the metal, according to the temperature and time of treatment.

In any case, given the high acidity of the treatment solution, the metallic surface is immediately attacked, with consequent conversion into phosphate. The treatment therefore does not require protracted immersion time for attack to take place, nor the application of high temperatures. The thickness of the film will depend only on the concentration of the solution.

As previously noted, multiple advantages flow from the present procedure, including high speed of application, ability to permit cold application, the permitting of simpler and less expensive installations, and the formation of an improved protective film.

The conventional treatments for aluminum currently include hexavalent chromium compositions. The remnants of these compositions are very high pollutants of water, thus causing very expensive installations for purification. The composition we are dealing with does not always require presence of hexavalent chromium. The chromium can all be in the form of trivalent chromium, which will be eliminated from the remnant product by precipitation with alkalis, such as lime (O Ca) and subsequent filtration. Another advantage of this process is consequently the reduction of water pollution.

Since compounds of the product remain wholly on the metal, organic polymers may be incorporated in the treatment material, which polymers may be selected to have a structural affinity with the resins which will form part of the paints to be subsequently applied. It is therefore possible to assure that the paints have excellent adherence and the metal may undergo severe deformation without release of the paint.

It is also necessary that the organic polymers be insoluble in water after drying, which can generally be achieved by a heat cure. The most suitable polymers are the acrylics with thermosetting properties. Through the use of polymers the corrosive-resistant properties are improved. Compatible pigments may be added to the polymer mix.

It will thus be appreciated that the resultant film, where polymers are included, acts not merely as a phosphating coating but also serves the function of a primer or first coat of paint.

Particularly when the composition is used in very high concentrations, rendering film thicknesses above 5 microns, and especially from 10 to 15 microns, very important anticorrosive properties are obtained, e.g. up to 300 to 400 hours in a spray salt test at 5%. These values are much higher than those of a primer in a water medium (hydrosoluble). Accordingly, in some cases the coating may perform the functions both of the phosphating agent as well as the first coat of paint, with a consequent reduction in the operations required, as noted below:

| Conventional operation | described composition |
|---|---|
| degreasing | degreasing |
| rinsing | rinsing |
| phosphatization | |
| Rinsing | |
| passivating | |
| drying | |
| priming | phosphating composition (film 10 microns) |
| curing | curing |
| top coat | top coat |
| curing | curing |

Paint adherence is not only increased on traditionally treated materials, such as steel, aluminum and zinc, but also offers good results on tin and its alloys, copper and its alloys and, generally speaking, on the majority of metallic surfaces.

The invention is further directed to a treatment composition adapted to be applied to metallic surfaces for the formation thereon of a film of the type described.

The process consists generally of the following stages:

STAGE I

Primary phosphates of zinc, manganese, lead or iron are incorporated into a solution of phosphoric acid or derivatives, such as borophosphoric acid, the acid esters of phosphoric, etc. Phosphates may be formed by dissolving salts of the noted metals in the acid, by way of example oxides or carbonates.

STAGE II

An organic reducing agent is added to the solution of Stage I. By way of example and without limitation, preferred reducing agents are those containing groups of hydroxyls, amines, aldehydes and ketones. Among them are the followng: carbohydrates (saccharoses), cellulose and its derivatives, starches, feculas, polyalcohols, primary, secondary and tertiary alcohols, aliphatics, aromatics or heterocyclics, esters, primary, secondary and tertiary amines and, in general, substances containing hydroxylated groups or free amines, whether aliphatic, aromatic or heterocyclic form suitable reducing agents. The reducing agents may be added directly to the solution of Stage I or may be themselves dissolved in one of the noted phosphoric acids or derivatives, and then added.

STAGE III

The resultant composition is partially oxidized under control by the action of chromic acid and/or its salts. The quantity of chromic acid required to be added will depend upon the quantity of reducing agent added in the second phase.

In Stage III a reaction is initiated which partially reduces the hexavalent chrome to trivalent chrome, forming a phosphate of soluble chrome (chromi-chromates-phosphoric acid) and obtaining a transparent green solution signifying the presence of the trivalent chromium which will have been formed as a result of the oxidation $\rightleftarrows$ reduction ("redox") reaction. It is usually preferable to have a certain amount of hexavalent chromium present since the passivation properties will be better. The quantity may be varied according to the metal to be treated, and preferably should be maintained between 0 and 5% by weight expressed in chromic anhydride ($CrO_3$), optimum values being between 0.05 to 0.8% in the solution to be used.

STAGE IV

The resultant solution may be applied to a metallic surface, e. g. iron, zinc, aluminum, etc. This initiates the reaction with the metal and a consequent deposit of metallic phosphates, together with the formation of a transparent film which adheres well to the metallic surface, is highly resistant to corrosion and completely insoluble in water. The film forming process is accelerated when the solution is heated.

The chromium hexavalent ions and trivalent ions present in the composition have passivating characteristics.

Reticulation and insolubilization can also be improved by the addition of tannic acid, acrylic acid or their derivatives and also by polycarboxylic or hydrocarboxylic acids.

To this basic composition other products can be added, such as:

Accelerators such as fluorides, nitrates, nitrites, oxalic acid, boric acid, fluosilicates, picric acid, ethylenediaminetetracetic acid, among others.

Hardeners, such as ammonia salts and aliphatic, aromatic or heterocyclic amines, especially quanidine, phenolbiguanidine, diethylenetriamine, morpholine, melamine and its derivatives, urea, phenolurea and polyurea; also benzidine-substitutes, quaternary bases, diciandimine, succinamide, aniline, toluidine, xylidine, phthalimine, polyvinylamine, acrylamine, resins and amine complexes.

Plasticizers may also be added, such as alcohols; polyvinyls, polyallyls, allylized starch, glycols and polyglycols, and polyoxyethylene derivatives.

Corrosion inhibitors, such as borates, primary, secondary and tertiary amines, etoxylated amines, nitrophenols, among others, may be employed.

Also, when the surface is to be painted, substances with amine, hydroxyl and carboxyl groups and others that are chemically active and capable of reacting with the resins contained in the paints may be incorporated to augment the bond to the paint, etc.

Also resins in solution, emulsion or dispersion, such as acrylic, etc. These confer better adherence of any later organic coatings since they will penetrate into the phosphatic film. The advantage of this process in eliminating washing the surface also enables these soluble substances to be held in the phosphatic layer until they are later rendered insoluble during the drying-baking period.

The treatment solution may be modified through the addition of humectants, antifoaming agents, chelaters and other auxiliary products in low quantities.

This polyvalent product can be applied by immersion, cold or hot sprays, brushes, rollers, etc.

Components which have been treated by immersion or spraying are dried, preferably in a oven, at a temperature which varies from approximately 50° C to 350° C. This accelerates the reticulation of the components. The temperatures suitable for baking paints can also serve to achieve reticulation of the phosphatic film.

If the phosphatic liquid is applied hot to the metallic surface, the reaction is quicker. The concentration of the solution for use depends on the effect desired. The more concentrated the solution is, the greater the protection against corrosion will be.

The invention is illustrated below by various examples in which the process was used, such examples to be regarded on a purely informative rather than on a limitative basis.

EXAMPLE

Zinc oxide is added to commercial phosphoric acid (85%), preferably when hot, in order to form a primary soluble phosphate of zinc. Reducing substances as described above, such as ethyleneglycol, are then added to the solution, which is mixed when cold. These reducing groups are oxidized next with chromic acid or its salt. This reaction, which will occur when cold, can be accelerated by raising the temperature. The product then acquires a green color, proving at the same time that at least a portion of the hexavalent chrome has been reduced to trivalent chrome. Substances with film-forming properties, such as acrylic dispersions, can then be added, and the metal treated.

Numerous variations will occur to those skilled in the art relating to corrosion resistant coating formation, and by way of guide lines, the following additional specifics should be considered.

1. Metals to be treated.

The phosphating composition in accordance with the present invention may be used with a wide variety of metals. By way of example, iron, zinc, aluminum, steel, aluminized steel, galvanized steel, aluminum alloys, zinc alloys, copper and its alloys, tin and its alloys.

2. In forming the primary zinc, manganese, lead or iron phosphates or a mixture thereof, it is preferable to employ as a starting material a metallic oxide or cabonate of the said groups and to dissolve the same in a solution of 40 to 100% phosphoric acid. The dissolving process may be accelerated by heating.

3. Of the reducing substances mentioned hereinbefore, the ones found the most useful are those containing hydroxyl groups (—OH), such as ethylene glycol $HOCH_2—CH_2OH$, and the amines.

4. With respect to the partial oxidation of the resultant composition through the addition of chromic acid or its salts, the quantity of chromic acid will, as may be anticipated, depend upon the quantity of reducing agent added.

It is preferable to have a certain amount of hexavalent chromium present in the solution since the passivation properties will be thereby improved. The quantity will vary according to the metals to be treated, i.e. steel or zinc. In the treatment of aluminum, the existence of hexavalent chromium is optional. The quantity is best determined on a pilot basis but, by way of guide lines and without limitation, should be estimated between 0 and 5% expressed in chromic anhydride ($CrO_3$), the optimum values of $CrO_3$ being 0.05 and 0.8% in the treatment solution to be used. Due to the oxidation $\rightleftarrows$ reduction (redox) reaction, the product will acquire a green color characteristic of the trivalent chromium which will have formed. Best performance will occur in a highly acid environment when the pH is between about 1 and 3.

5. The incorporation of resins in a water base improves the adhesion of paints extraordinarily and results in better anti-corrosion resistance. The number of resins which may satisfactorily be employed is virtually unlimited, as essential condition being that they must be stable in the strong acid pH range which is preferred.

By way of example of organic polymers which may be used, there may be mentioned acrylics, vinyl acrylic or styrene acrylic copolymers, especially those with thermo-setting properties. Paint adhesion will improve with the higher proportion of polymers. Optimal concentration of polymer may be determined by experimentation and may vary, for instance, between 0.25 to 20 times by weight of the phosphating composition components in the formulation i.e. the total weight of active components other than the polymer dispersion.

6. Treatment of the metal surfaces may be by immersion, spraying, roller or brush application. Treatment time may be very short, even less than one second in some instances. It is only necessary to wet the surface.

7. The treated surfaces may be dried by any standard method until the water has evaporated. If they are cured at temperatures ranging from 100° to 350° C (depending upon the composition and particularly on the polymers) for five seconds to thirty minutes, the nature of the film reticulation and its anti-corrosion resistance and paint adherence are varied in the advantageous manner.

By way of practical examples, the following specific formulations may be mentioned:

| Example A | parts by weight |
|---|---|
| Phoshoric acid 75% | 30 |
| Zinc oxide | 3 |
| Ethylene glycol | 4 |
| a 10% water dispersion of chromic acid | 63 |

| Example B | parts by weight |
|---|---|
| Phosphoric acid 85% | 50 |
| Zinc oxide | 4 |
| Iron oxide | 2 |
| Starch | 3 |
| Water | 3 |
| a 10% solution of sodium dichromate in water | 38 |

EXAMPLE C

To the composition of the examples A and B, solutions, dispersions or emulsions of acrylic polymers are added (containing approximately 30 to 60% of solids) in the following proportions:

| | parts by weight |
|---|---|
| Composition A or B | 1 |
| Acrylic Polymer | 0.25 to 20 |

The most usual proportions are from 1:1 to 1:6 parts, respectively.

These mixtures are stable, without forming any precipitations or separations. The total content of water is normally between 25 and 75%.

As noted, the metallic oxides are preferably first dissolved in the phosphoric acid, following which the reducing agent is added and then the chromic acid or salt.

The treatment solution prepared as noted may be used directly, or preferably can be diluted with water, depending upon the desired end result. Anti-corrosive properties increase with the thickness of the film.

The treatment on steel will be used in a concentrated form (50 to 100%), when it is desired to obtain phosphating and primer properties at the same time. When phosphating properties only are wanted, with film thicknesses of 1 to 3 microns, the most usual concentrations will be from 10 to 30%. In connection with aluminum and galvanized steel, the concentrations will be from 10 to 40%, also in order to obtain film thicknesses from 1 to 3 microns.

As heretofore noted, the principal advantages of the instant process are the production of improved protective films and elimination of the rinsing and chromic passivation stages inherent in prior known processes, with consequent reduction in the time and equipment needed for processing. Without limitation to any specific theory, the improved operation is considered to be a consequence of the formation in situ of trivalent chromium salts which have, as a result of the initial phosphate-reducing agent reaction, a complex, closed structure, since during the subsequent reaction trivalent chromium is being generated.

The film obtained is completely water resistant and is not hygroscopic, in contrast to films initially generated in traditional zinc or iron phosphatizing procedures. The film's water insolubility characteristics are especially enhanced when the metal is treated at high temperatures, such films offering notable anti-corrosive protection.

The phosphates, in contrast to standard procedures, do not have to become insoluble by progressive attack of the metal but, rather, the film is deposited and becomes insoluble during drying.

In any case, given the preferred high acidity of the treatment solution, the metallic surface is immediately attacked, with consequent conversion into phosphate. The treatment is not, therefore, subject to a certain immersion time for attack to take place; nor to certain required temperatures, as is the case with conventional phosphatization procedures.

Since the components of the reaction product remain wholly on the metal, various organic polymer compounds may be incorporated therein, which compounds may be selected to have a structural affinity with the resins of the paint to be later applied, giving rise to a strong bond of the film to the paint, as well as enabling the metal to be severely deformed without loss of adherence between the film and paint.

While it has been stated that certain polymeric compounds may be added, it should be appreciated that the disclosure hereof is intended to encompass the addition of materials whereby polymers are formed in situ.

It will be appreciated that, as is the case with phosphatizing procedures heretofore known, experimentation in order to optimize results in respect of the specific parameters occurring in any given operation are to be anticipated. Without limitation, such factors as the composition of the material to be coated, the speed with which the coating is to be formed, corrosion anticipated on the surface of the pretreated metal, thickness and texture of the coating sought to be formed, the treatment to which the coated material will be subject, e. g. whether the material is to be painted, plated, etc. must be considered.

Numerous variations will occur to those skilled in the art in the light of the foregoing disclosure, and adaptation of the procedure to a particular intended result may be readily accomplished. For instance, where polymers are included in the treatment solution, it will be obvious that the heating during drying must be effected at temperatures which will not decompose the polymer.

Similarly, where a polymer is embodied in the composition, it will be evident that the polymer must be selected so as to be resistant to the highly acid range in which the procedure is preferably practiced.

No attempt has been made herein to list each and every ingredient which may be suitably employed in the composition. Particularly in the area of organic reducing agents and polymers, the present disclosure may suggest to the skilled worker alternate compositions which may be substituted for or used in conjunction with the mentioned compositions.

For instance, where polymers are present in the treatment composition, it is feasible to incorporate pigments of various sorts compatible with the composition, in which case the coating will act as the primer or first paint coating of the metal.

Accordingly, the invention is to be broadly construed within the scope of the appended claims.

Having thus described the invention and, illustrated its use, what is claimed as new and is desired to be secured by Letters Patent is:

1. The method of forming a corrosion resistant coating on metals which provides, in addition, an adherent surface for paints, comprising forming a treatment solution by dissolving in an acid selected from the group consisting of phosphoric, boro-phosphoric and the acid esters of phosphoric at least one metal salt selected from the group consisting of the salts of zinc, manganese, iron and lead in an amount sufficient to provide a solution of primary phosphates of said metals, adding to the said solution containing said primary phosphates an organic reducing agent, partially oxidizing the resultant composition through the addition of chromic acid or its salts in quantity sufficient to produce in said solution trivalent chromium ions, applying said treatment solution to the surface of a metal, said solution being in the pH range of from about 1 to 3, and thereafter drying the treated metal surface to form thereon a reticulated film strongly adherent to the base metal.

2. The method of claim 1 wherein said drying step is accelerated and the nature and durability of the reticulated film improved by heating said treated metal.

3. The method in accordance with claim 1 wherein said treatment solution is heated during application to said metal.

4. The method in accordance with claim 1 and including the step of adding to said treatment solution a polymer in an aqueous solution, emulsion or dispersion whereby the resultant film is rendered especially receptive to subsequent polymer based paint coatings compatible with the added polymer.

5. The method in accordance with claim 4 including the step of heating said treated metal surface at temperatures in the range of 50° C to 350° C.

6. A treatment composition for forming in a single application a corrosion resistant coating on metals which provides in addition an adherent surface for paints, comprising a solution including at least one primary phosphate of a metal selected from the group consisting of zinc, manganese, iron and lead, an organic reducing agent, and chromic acid or its salts, in quantity sufficient to at least partially oxidize the reducing agent, and provide in said composition trivalent chromium ions, said composition being in the pH range of from about 1 to 3.

7. A treatment composition in accordance with claim 6 and including an acrylic polymer in an aqueous solution, emulsion or dispersion, said polymer being stable in the said pH range.

8. A treatment composition in accordance with claim 7 wherein said polymer is selected from the group consisting of acrylics, vinyl acrylics, and styrene acrylics.

9. A treatment composition in accordance with claim 7 and including pigments.

10. A treatment composition in accordance with claim 6 wherein said organic reducing agent is selected from the group consisting of hydroxyls, amines, aldehydes and ketones.

* * * * *